US005117973A

United States Patent [19]

Lo Duca

[11] Patent Number: 5,117,973

[45] Date of Patent: Jun. 2, 1992

[54] BOX WITH A SUPPLEMENTARY RAISABLE PANEL AND OFFSET CREASING LINE HOLES

[75] Inventor: Carmelo Lo Duca, Milan, Italy

[73] Assignee: Gi.Bi.Effe S.R.L., Milan, Italy

[21] Appl. No.: 683,797

[22] Filed: Apr. 11, 1991

[30] Foreign Application Priority Data

Apr. 30, 1990 [IT] Italy ..... 20176 A/90
Jul. 31, 1990 [IT] Italy ..... 21136 A/90

[51] Int. Cl.[5] ..... B65D 51/00

[52] U.S. Cl. ..... 206/45.29; 229/DIG. 4

[58] Field of Search ..... 206/45.29, 45.28, 44, 206/459, 831; 40/306, 312; 229/DIG. 4

[56] References Cited

U.S. PATENT DOCUMENTS

| | | | |
|---|---|---|---|
| 283,741 | 8/1883 | Appleberg | 40/312 |
| 823,604 | 6/1906 | Isacke | 206/45.28 |
| 1,116,043 | 11/1914 | Elliott | 206/831 X |
| 1,534,261 | 4/1925 | Furste | 206/45.29 |
| 1,771,760 | 7/1930 | MacLellan | 229/DIG. 4 |
| 1,824,927 | 9/1931 | Powell | 206/45.14 |
| 2,134,971 | 11/1938 | Guyer | 40/312 |
| 2,137,420 | 11/1938 | Soybel | 206/45.29 |
| 2,342,873 | 2/1944 | Lester | 206/45.29 |
| 3,756,384 | 9/1973 | Stone | 40/312 X |
| 3,899,123 | 8/1975 | Stollberg et al. | 229/DIG. 4 |
| 4,108,350 | 8/1978 | Forbes, Jr. | 206/459 X |

FOREIGN PATENT DOCUMENTS

| | | | |
|---|---|---|---|
| 0234079 | 9/1987 | European Pat. Off. . | |
| 2456613 | 5/1979 | France . | |
| 162598 | 4/1921 | United Kingdom | 206/44 R |
| 2104048 | 3/1983 | United Kingdom . | |

*Primary Examiner*—Bryon P. Gehman
*Attorney, Agent, or Firm*—Oblon, Spivak, McClelland, Maier & Neustadt

[57] ABSTRACT

A box formed from a single sheet of punched and cut cardboard, the box having any conventional structure defined by at least three main panels plus tabs and side panels for closing the box, and being characterized in that from the free edge of one of the main panels there projects a supplementary panel connected to it along a preformed creasing line. The supplementary panel can be rotated about its own creasing line between a position in which it rests on and can be removably secured to one of the main panels of the box, and a position raised therefrom. Writing and illustrations not otherwise reproducible on the main faces of a traditional box can be reproduced on the two faces of the supplementary panel. Along the creasing line of the supplementary panel and along the underlying creasing line of the box main panel there are provided mutually-offset elongate holes which allow simple machine assembly of the box using traditional machines.

2 Claims, 2 Drawing Sheets

BOX WITH A SUPPLEMENTARY RAISABLE PANEL AND OFFSET CREASING LINE HOLES

BACKGROUND OF THE INVENTION

This invention relates to a box having a supplementary panel rotatable about a creasing line and projecting from the box. Traditional boxes constructed from a single sheet of flexible material (usually cardboard) have a polygonal cross-section which is sometimes triangular but is more often quadrangular, rectangular or square. They are defined by main panels separated from each other by parallel creasing lines, plus tabs and side panels for closing the box which project laterally from the main panels and are separated from these by longitudinal creasing lines perpedicular to those which separate the main panels from each other. From one main panel there projects a flap which is separated from it by a creasing line parallel to those which separate the main panels from each other, and is glued to the inside of that main panel which is furthest from it on the sheet from which the box is formed.

A box of traditional structure, for example of quadrangular cross-section, has four main panels, on the outer surface of which writing or drawings can be reproduced. The surface of these panels is often insufficient to hold all the writing which it would be desirable to reproduce on them. Illustrative leaflets must therefore be used, these being inserted into the box together with the products to be contained in the box.

Increasingly frequently such boxes contain products to be sold in various countries of different languages. There is insufficient space on traditional boxes, especially if of small size (such as boxes which are to contain pharmaceutical specialities), to print the same instructions in more than one language, so making it necessary to use different boxes for countries of different languages.

SUMMARY OF THE INVENTION

This is a serious drawback, it being therefore the main object of the present invention to overcome the above drawbacks by providing for boxes having substantially the shape of traditional boxes but differing from these by comprising on the outside of the structure of the traditional box a rotatable panel having two supplementary surfaces additional to the surfaces of the constituent panels of the traditional box, and on which there can be reproduced further writing or drawings which could not be reproduced on a box of known type.

A further object of the invention is to provide boxes with additional printable surfaces which can be obtained from a single sheet of cut and punched flexible material.

These objects are attained by a box formed from a single sheet of flexible punched and cut material, the box having a substantially polygonal cross-section with at least three consecutive main panels and a flap projecting from one of these, the panels and the flap being separated from each other along parallel creasing lines, the flap being glued to the inside of that main panel which on the sheet forming the box is furthest from that from which it projects, the box comprising tabs and side panels for closing the box which project laterally from the main panels and are connected to these along creasing lines perpendicular to the creasing lines which separate the main panels and the flap from each other, characterized in that from the furthest main panel there projects a supplementary panel separated from it along a creasing line which is parallel to those which separate the main panels from each other, and is superposed on the creasing line which separates the flap from the main panel with which it is rigid, the supplementary panel being rotatable about its own creasing line between a position in which it rests on the main panel from which the flap projects, and a position raised therefrom.

Preferably, elongate holes are provided in the flexible material sheet along the superposed creasing lines, the holes delimiting appendices which connect the flap and the panel to the relative main panels respectively, the holes provided along one creasing line being offset from those of the other creasing line and their length being at least equal to the width of the appendices on which the holes are superposed.

Again preferably, a plurality of the holes are provided to delimit a plurality of the appendices.

The flexible material sheet from which the box is formed is generally of cardboard.

The invention also relates to the sheet in the form of a single piece of punched and cut flexible material for forming a box provided with a rotatable free panel, as heretofore defined.

BRIEF DESCRIPTION OF THE DRAWINGS

To clarify the structure and characteristics of the box and the sheet from which it is formed, a preferred embodiment is described hereinafter by way of non-limiting example with reference to the accompanying drawings in which.

DESCRIPTION OF THE PREFERRED EMBODIMENTS

Figure 1:
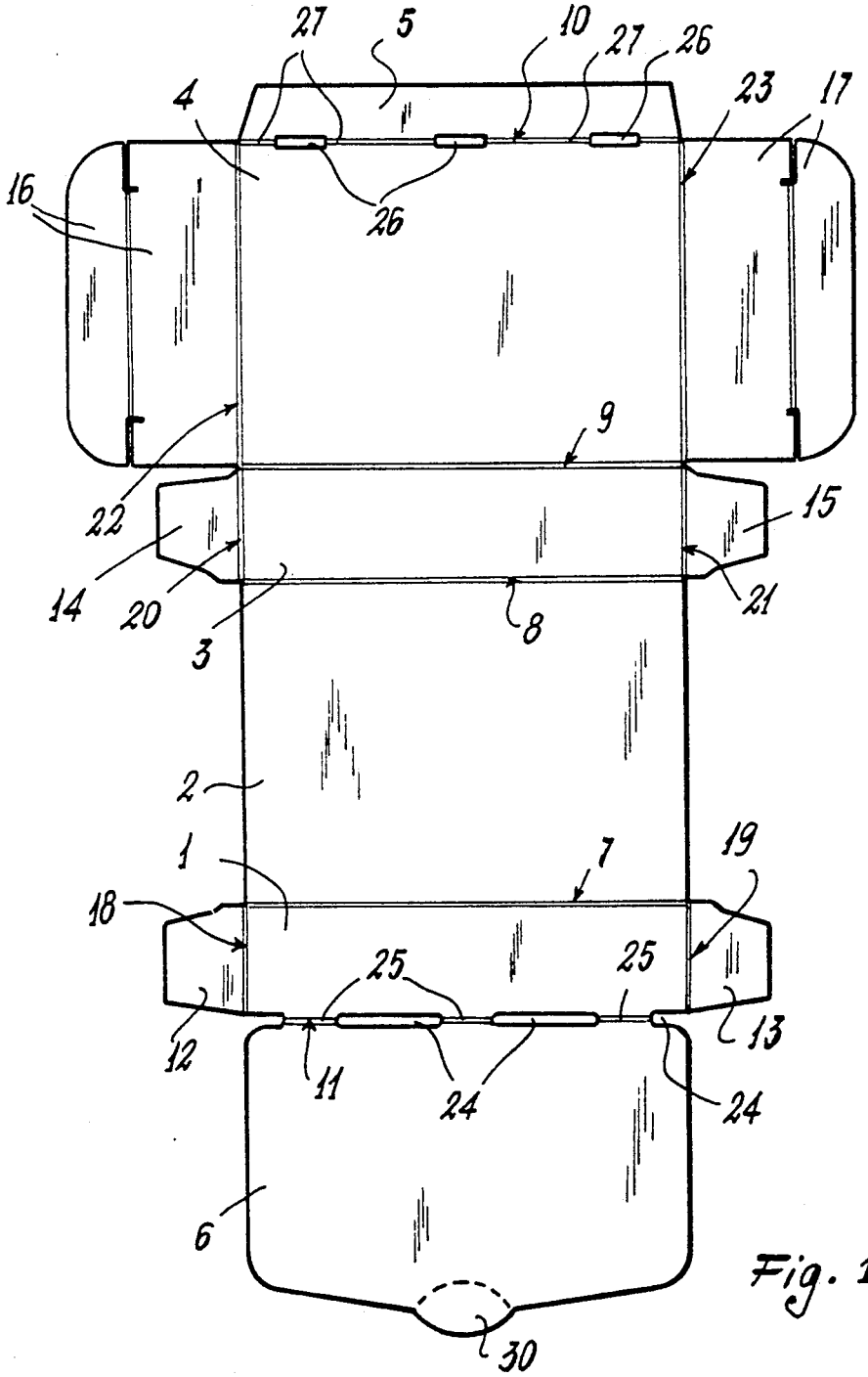
FIG. 1 is a plan view of a sheet of punched and holed cardboard for forming a box of rectangular cross-section provided with a supplementary panel.
Figure 2:
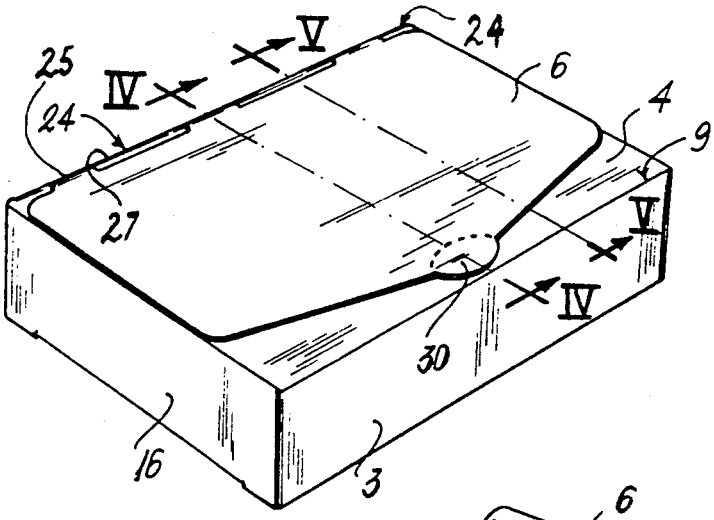
FIGS. 2 and 3 are perspective views taken respectively from one side and the opposite side of the box obtained from the sheet of FIG. 1, the supplementary panel being shown lowered onto the box and raised therefrom respectively.
Figure 3:
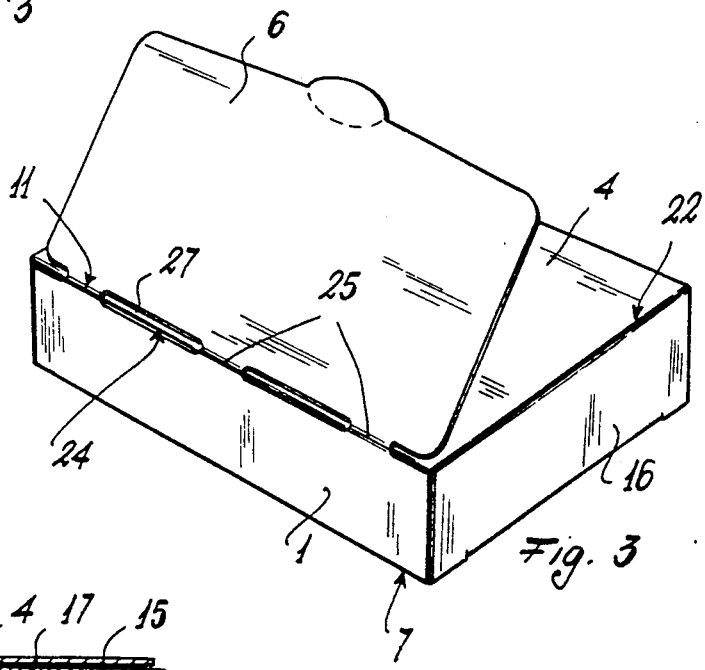
Figure 4:
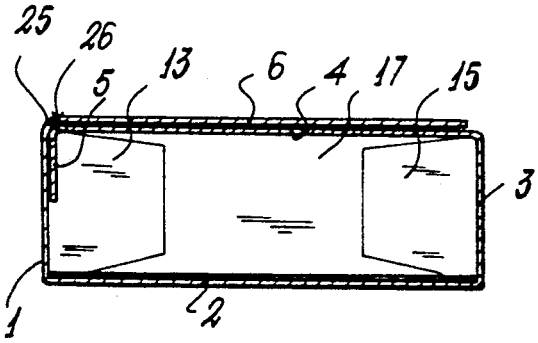
FIGS. 4 and 5 are two schematic sections through the box, taken on the lines IV—IV and V—V of FIG. 2 respectively.
Figure 5:
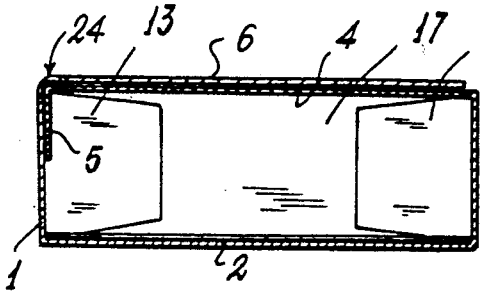

FIG. 1 shows, spread out in a single plane, a punched and cut single-piece cardboard sheet comprising four main panels 1, 2, 3 and 4 respectively, a gluing flap 5 and a supplementary panel 6, these being separated from each other by parallel creasing lines 7, 8, 9, 10 and 11 respectively. The panels 1 and 3 have exactly the same width and height (i.e. dimensions), as have the panels 2 and 4.

From the sides of the main panels there project tabs 12, 13, 14 and 15 and, respectively, side panels 16 and 17 connected to the respective main panels along creasing lines 18, 19, 20, 21, 22 and 23 perpendicular to the lines which separate the main panels from each other.

In the cardboard sheet, along the creasing line 11 there are provided elongate holes 24 which delimit appendices 25 by which the panel 6 is connected to the panel 1. Likewise, along the creasing line 10 there are provided elongate holes 26 which delimit appendices 27 by which the flap 5 is connected to the panel 4.

To form the box, the described sheet is folded in the conventional manner along the creasing lines 7, 8, 9, 10, and the outer face (with respect to FIG. 1) of the flap 5 is glued to the inside of the main panel 1. In this manner (FIGS. 2 to 5) the creasing line 10 lies along the creasing line 11.

The holes 24 and 26 are mutually offset to define appendices 25 and respectively 27 of such a length that when the supplementary panel 6 is folded (along its creasing line 11) to lie on the outer face of the main panel 4 (FIGS. 2, 4 and 5), the appendices 25 are exactly superposed on the holes 26, whereas the holes 24 are exactly superposed on the appendices 27. It should be noted that the length of the holes 26 is equal to or greater than the width of the appendices 25 and that the length of the holes 24 is equal to or slightly greater than the width of the appendices 27.

In this manner, when the supplementary panel 6 is rested on the outer surface of the main panel 4 (onto which it can be glued at the appendix 30, which is separable from the panel 6 along the preformed tear-off line represented by dashes on the drawing), the height of the box at the two creasing lines which delimit the panel 1 is exactly equal to its height at the panel 3.

The sheet shown in FIG. 1 can thus be formed into a box using conventional assembly machines without having to substantially modify them. After the flap 5 has been glued to the inside of the main panel 1 and the supplementary panel 6 has been rested on the outer surface of the main panel 4, the box (with its side panels open) can be pressed, i.e. folded along two opposing creasing lines, to assume a flat form which enables it to be packaged into packs for transport to the user.

Thus the presence, the arrangement and the sizing of the elongate holes 24, 26 enable boxes to be formed provided with supplementary panels (such as those indicated by 6 on the drawings) having practically the same dimensions as the boxes would have if the supplementary panel were not provided. In fact, the presence of the supplementary panel resting on the main panel 4 results in a thickness increase at this panel, but this does not cause problems because this thickness is increase is absorbed by the flexibility of the panel 4.

Writing, illustrations or the like can thus be reproduced on both faces of the supplementary panel 6, so substantially enlarging the surface (that of the panels 1, 2, 3, 4, 16 and 17) on which writing could be otherwise reproduced on a box of conventional structure. In practice, the two surfaces of the supplementary panel 6 are available for printing, and can be equal in size to the largest panel (2 or 4) of the box. Such printed matter, accessible to the box user, can comprise bilingual or multilingual instructions or information, this being very important if the product contained in the box is to be sold in a number of countries of different languages.

The best results are obtained if the elongate holes 24, 26 are provided, but it is apparent that the present invention also covers the case in which the holes are not provided.

It is also apparent that boxes provided with the rotatable supplementary panel can be of any cross-section, for example triangular, quadrangular or polygonal, i.e. they can comprise three or more than three main consecutive panels.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A sheet in the form of a single piece of punched and cut flexible material for forming a box provided with a free panel rotatable between a position in which it rests on a main panel of the box and a position raised therefrom, said sheet comprising at least three consecutive main panels and a flap projecting from one of said at least three consecutive main panels, said panels and the flap being separated from each other along parallel creasing lines, and comprising tabs and side panels for closing the box, said tabs and side panels projecting laterally from the main panels and being connected to the main panels along further creasing lines perpendicular to the parallel creasing lines which separate the main panels and the flap from each other, wherein from the main panel furthest from the main panel from which said flap projects there extends a supplementary panel separated from said furthest main panel along a creasing line which is parallel to the parallel creasing lines which separate the main panels from each other;

wherein at and along the creasing lines which separate said flap and, respectively, said supplementary panel from the main panels adjacent to them there are provide elongate holes, of which the elongate holes on one creasing line are offset from the elongate holes on the other creasing line, and which delimit respective appendices having a width equal to or less than the length of said holes provided in the other respective creasing line.

2. A box formed from a single sheet of flexible punched and cut material, comprising:

at least three consecutive main panels and a flap projecting from one of the at least three consecutive main panels, said box having a substantially polygonal cross-section, said panels and said flap being separated from each other along parallel creasing lines, the flap being fixedly glued to the inside of another of said at least three consecutive main panels which on the sheet forming the box is furthest from the one main panel from which the flap projects;

tabs and side panels for closing the box, said tabs and side panels projecting laterally from the main panels and being connected to said main panels along further creasing lines which are perpendicular to the parallel creasing lines which separated the main panels and the flap from each other;

a supplementary panel projecting from the main panel to which said flap is glued, said supplementary panel being separated from the main panel to which said flap is glued along a creasing line which is parallel to the parallel creasing lines which separate the main panels from each other and is superposed on the parallel creasing line which separates the flap from the main panel from which the flap projects, the supplementary panel being rotatable about the creasing line separating the supplementary panel from the main panel from which the supplementary panel extends between a position in which the supplementary panel rests on the main panel from which the flap projects, and a position raised therefrom; and elongate holes provided in the flexible sheet along said creasing lines respectively separating said supplementary panel and said flap from the respective main panels from which they extend, said holes delimiting appendices which connect said flap and the supplementary panel to the respective main panels from which they extend, the holes provided along one creasing line being offset from those of the other creasing line and the length of the holes being at least equal to the width of the appendices on which said holes are superposed.

* * * * *